US006344714B1

(12) United States Patent
Su et al.

(10) Patent No.: US 6,344,714 B1
(45) Date of Patent: Feb. 5, 2002

(54) PLASMA DISPLAY PANEL DEVICE WITH AUXILIARY ELECTRODE

(75) Inventors: Yao-Ching Su, Tainan Hsien; Wen-Fa Sung, Hsinchu; Yih-Jer Lin, Kaohsiung, all of (TW)

(73) Assignee: Acer Display Technology, Inc., Hsinchu (TW)

( * ) Notice: Subject to any disclaimer, the term of this patent is extended or adjusted under 35 U.S.C. 154(b) by 0 days.

(21) Appl. No.: 09/450,900

(22) Filed: Nov. 29, 1999

(30) Foreign Application Priority Data

Nov. 30, 1998 (TW) ..... 87119834 A

(51) Int. Cl.[7] ..... H01J 17/49
(52) U.S. Cl. ..... 313/582; 313/631

(58) Field of Search ..... 313/582, 584, 313/631

(56) References Cited

U.S. PATENT DOCUMENTS 6,252,353 B1 * 6/2001 Ha et al. ..... 313/582

* cited by examiner

*Primary Examiner*—Vip Patel
(74) *Attorney, Agent, or Firm*—Ladas & Parry

(57) ABSTRACT

A plasma display panel device which can enlarge the bright region of a PDP with a given pixel size is provided. The auxiliary electrode of the plasma display panel device contacts not only the transparent electrode but also the substrate in order to avoid the auxiliary electrode being peeled off during the manufacturing process. Furthermore, the position of the auxiliary electrode is changed so the bright region between the pair of auxiliary electrodes is enlarged.

3 Claims, 3 Drawing Sheets

PLASMA DISPLAY PANEL DEVICE WITH AUXILIARY ELECTRODE

BACKGROUND OF THE INVENTION

1. Field of the Invention

This invention relates to a display device, particularly to a plasma display panel device with a large bright region.

2. Description of Prior Art

Normally, the electrodes on the front plate of a plasma display panel (herein referred to a PDP) are fabricated by known semiconductor process. These plasma display panels are classified as either transparent type or reflective type in terms of its luminant mechanism. The characteristic of the so-called transparent type PDP is that the fluorescence material is formed on the front plate. On the other hand, in a reflective type PDP, the fluorescence material is formed on the rear plate. The reflective type PDP is the topic of the recently researches.

The electrodes on the front plate comprise a transparent electrode and an auxiliary electrode. The transparent electrode is normally made of indium tin oxide (ITO). The auxiliary electrode is opaque and normally has a tri-layer structure such as Cr/Cu/Cr or Cr/Al/Cr. However, such a conventional electrode structure leads to certain drawbacks for a PDP, it might cause the poor utilization of light in the bright region.

Referring to FIG. 1*a,* a plasma display panel comprises a pair of parallel substrates including a first substrate 10*a* and a second substrate 10*b.* Plural pairs of transparent electrodes 12 parallel to each other are formed on the first substrate 10*a* and extending along a first direction. Plural pairs of auxiliary electrodes 14 parallel to each other are then formed on the plural pairs of transparent electrodes 12 and extending along the first direction. Further, a dielectric layer 16 is formed to cover the first substrate 10*a,* the plural pairs of transparent electrodes 12, and the plural pairs of auxiliary electrodes 14. On the second substrate 10*b,* a plurality of address electrodes 18 parallel to each other are formed thereon and extending along a second direction that is orthogonal to the first direction. A plurality of spacers 20 parallel to the plurality of address electrodes 18 are then formed on the second substrate 10*b* for defining the discharge space. Finally, a plurality of fluorescence layers 22 are formed between the plurality of spacers 20 for luminescence when the fluorescence layers 22 are radiated by ultraviolet light generated from gas in the discharge space.

Normally, the gas filled in the discharge space between the first substrate 10*a* and the second substrate 10*b* is Neon or Xenon. The gas breaks down when a voltage with an appropriate polarity is applied, and is then ionized to produce plasma. The fluorescence material is excited by the ultraviolet light generated by the plasma to produce a visible light, which is then emitted through the front substrate.

Referring to FIG. 1*b,* each auxiliary electrode 14 is completely adhered on each transparent electrode 12. The area A is the bright region and the area B is the dark region. Because the accuracy limitation of the photolithgraphy process, the edge of the auxiliary electrode can not align with the edge of the transparent electrode. There is a section 15 having a width of about 10~20 $\mu$m between the edges of the auxiliary electrode 14 and the transparent electrode 12. The section 15 is transparent although the auxiliary electrode is opaque. The light may transmit through the section 15, and the contrast of the panel is decreased.

Referring to FIG. 2, a black matrix 30 is added at the dark region in order to increase the contrast of the panel. However, three small bright regions 23, 24, 25 still appear in the dark region while the fluorescence material radiates visible light. The darkness level of the dark region is too high to gain a proper contrast.

Referring to FIG. 3, the black matrix 32 is further added to cover the gap between each pair of transparent electrodes 12 for improving the contrast of the plasma display panel. There is no bright region in the dark region. However, it can not enlarge the bright region for a given size of pixel. Moreover, the auxiliary electrode consist of Cr/Cu/Cr tends to be lifted-off in subsequent processes because of the poor adhesion between Cr and ITO. In addition, the Cr layer may be etched laterally because of the potential difference between Cr and ITO, and therefore, the adhesion between the auxiliary electrode and the transparent electrode may be decreased during the etching process. Further, bubbles might remain while the dielectric layer 16 is formed. These problems significantly affect the fabrication of a large-size PDP since a required evenness for PDP is difficult to achieve.

SUMMARY OF THE INVENTION

Accordingly, to solve the problems of the prior arts, an object of this invention is to provide a plasma display panel device which can enlarge the bright region for a PDP with a given pixel size.

Another object of this invention is to provide a plasma display panel device having an auxiliary electrode which is hardly peeled off by external force during the manufacturing process so as to improve the yield.

According to the present invention, a plasma display panel device has a first substrate and a second substrate with a discharge space therebetween, and a plurality of pairs of transparent electrodes formed on the first substrate, each of the transparent electrodes having a sidewall. A reverse slit where no surface discharge occurs is defined between each adjacent pair of transparent electrodes and a discharge slit for surface discharge therebetween is defined between the transparent electrodes of a single pair. The plasma display panel device includes a plurality of auxiliary electrodes provided near the reverse slits and each of the auxiliary electrodes has a first surface and a second surface. The first surface of each auxiliary electrode is in contact with the sidewall of each transparent electrode and the second surface of the auxiliary electrode is in contact with the first substrate so as to establish a direct adhesion between the auxiliary electrode and the first substrate. According to another aspect of the present invention, a panel of a plasma display includes a substrate, a transparent electrode formed on the substrate and having a sidewall, and an auxiliary electrode having a first surface and a second surface. The first surface is in contact with the sidewall of the transparent electrode and the second surface being in contact with the substrate so as to establish a direct adhesion between the auxiliary electrode and the substrate. The transparent electrode further includes an opening thereon for allowing the second surface of the auxiliary electrode to contact with the substrate through the opening.

DESCRIPTION OF THE DRAWINGS

The following detailed description, given by way of example and not intended to limit the invention solely to the embodiments described herein, will best be understood in conjunction with the accompanying drawings in which.

DETAILED DESCRIPTION OF THE PREFERRED EMBODIMENTS

The PDP disclosed by this invention can be fabricated by the conventional procedures and the fabrication parameters are similar to those used in the conventional PDP. Therefore, the present invention can be manufactured by conventional equipment without incurring extra cost.

In the present invention, the panel of the plasma display includes a substrate, a transparent electrode formed on the substrate and having a sidewall, and an auxiliary electrode having a first surface and a second surface. The first surface of the auxiliary electrode is in contact with the sidewall of the transparent electrode and the second surface of the auxiliary electrode is in contact with the substrate so as to establish a direct adhesion between the auxiliary electrode and the substrate. The transparent electrode further includes an opening thereon for allowing the second surface of the auxiliary electrode to contact with the substrate through the opening.

Figure 1A:
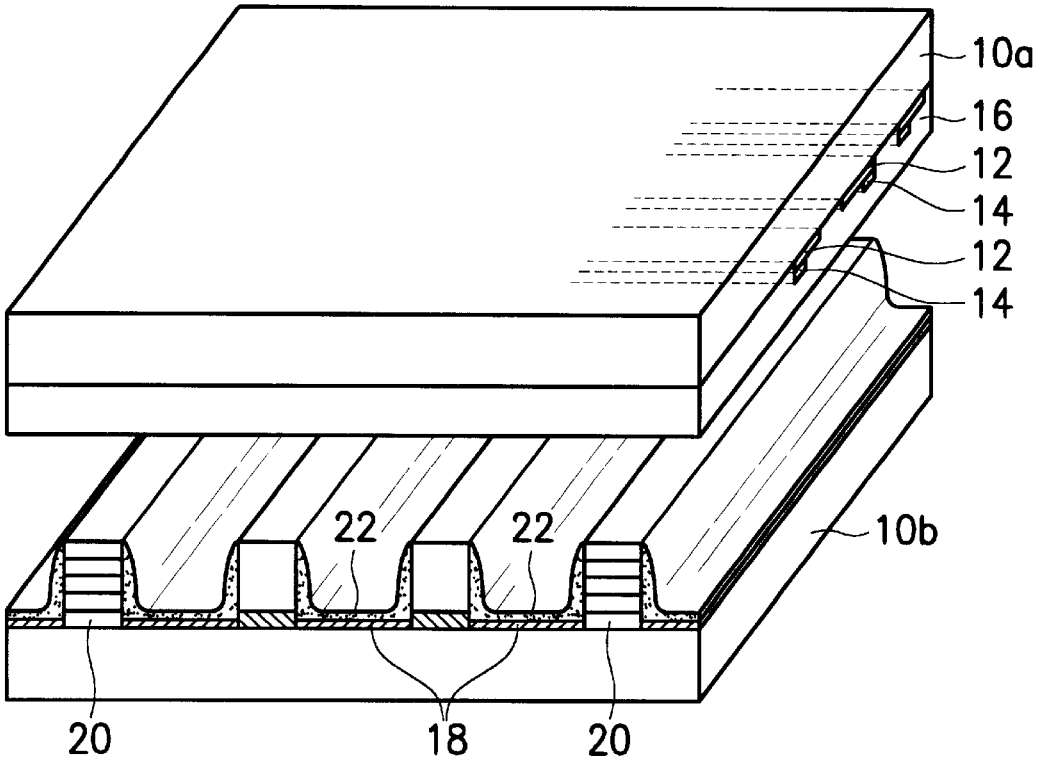
FIG. 1a (PRIOR ART)
FIG. 1*a* is a perspective diagram of a conventional plasma display panel device.
Figure 1B:
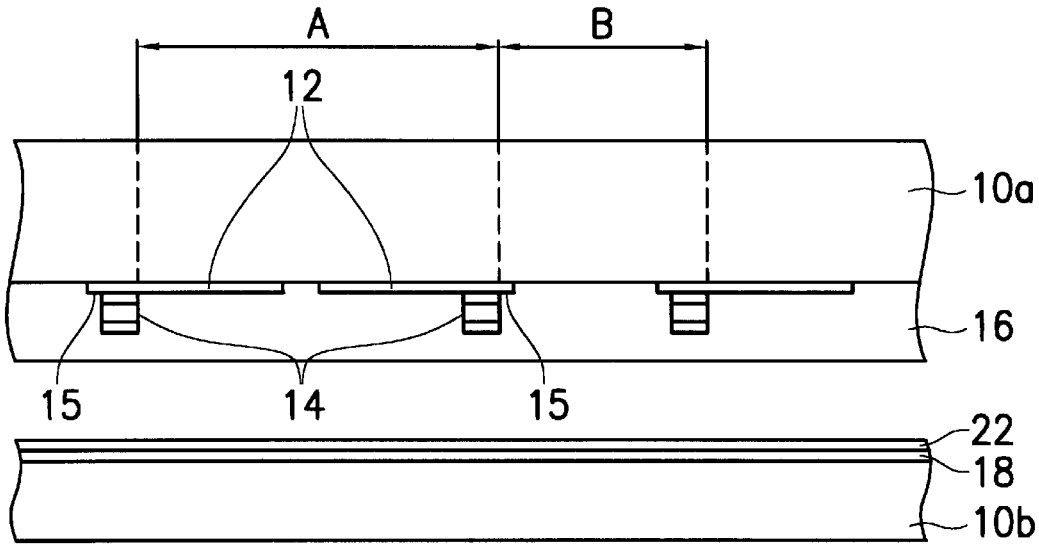
FIG. 1b (PRIOR ART)
FIG. 1*b* is a cross-sectional diagram of the conventional plasma display panel device shown in FIG. 1*a;*
Figure 2:
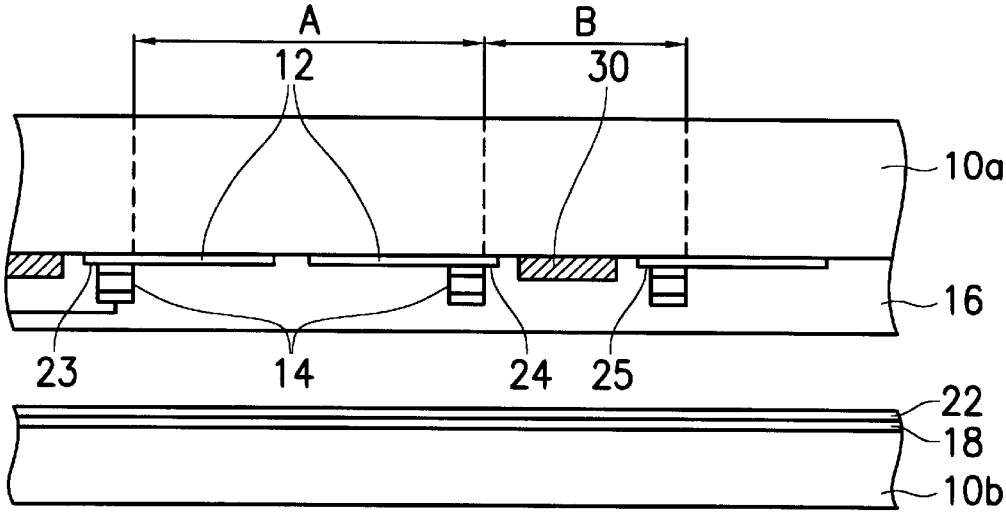
FIG. 2 (PRIOR ART)
FIG. 2 is a cross-sectional diagram of another conventional plasma display panel device.
Figure 3:
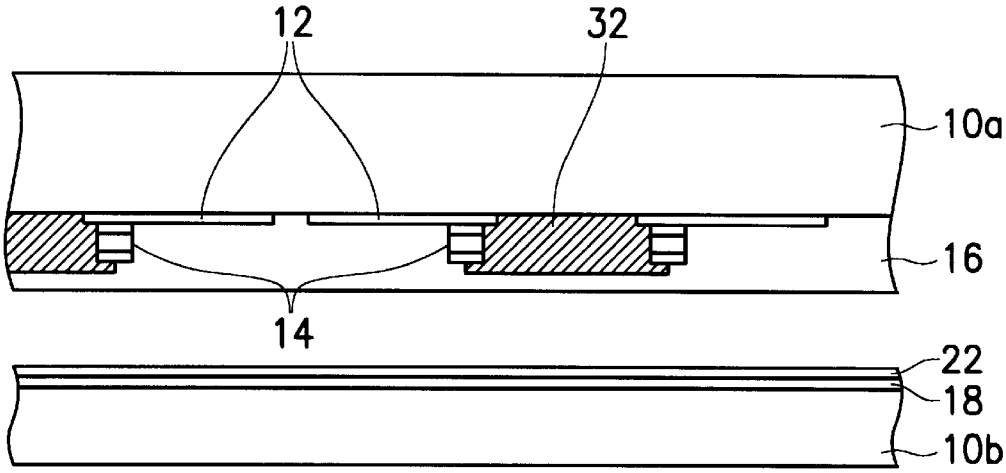
FIG. 3 (PRIOR ART)
FIG. 3 is a cross-sectional diagram of another conventional plasma display panel device.
Figure 4:
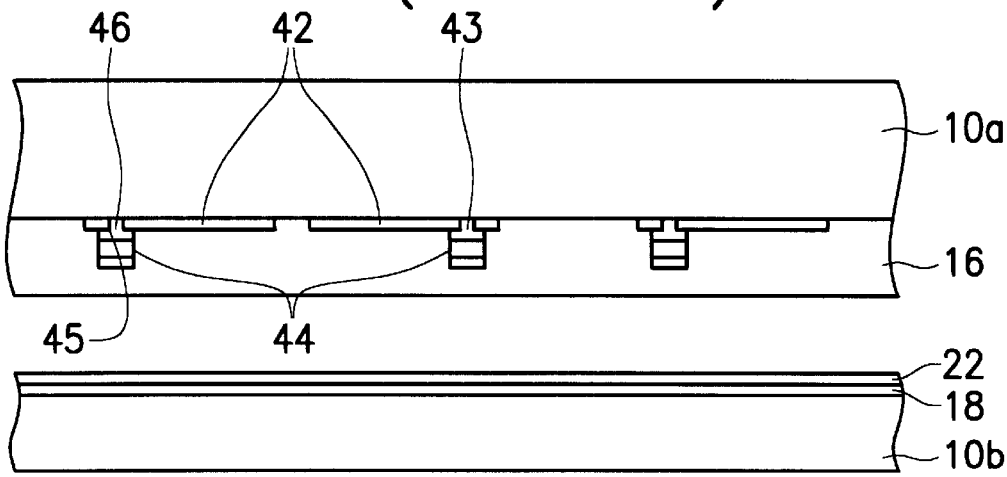
FIG. 4 is a cross-sectional diagram of a plasma display panel device according to one embodiment of this invention.

Referring to FIG. 4, a pair of transparent electrodes 42 are formed on the substrate 10*b*. A portion of each transparent electrode is removed by an etching process and an opening 43 is formed on the transparent electrode. When the auxiliary electrode 44 is formed above the transparent electrode 42, a first surface 45 of the auxiliary electrode is in contact with the sidewall of the transparent electrode. In the same time, a second surface 46 of the auxiliary electrode is in contact with the substrate so as to establish a direct adhesion between the auxiliary electrode and the substrate 10*a*. The adhesion between the Cr layer (the auxiliary electrode) and the glass (the substrate) is better than that between the Cr layer and the ITO (the transparent electrode). Therefore, the auxiliary electrode may not be peeled off easily.

In the first embodiment as shown in FIG. 4, a PDP comprises: a pair of substrates including a first substrate 10*a* and a second substrate 10*b*, which are disposed against each other to form a discharge space; plural pairs of transparent electrodes 42 parallel to each other, which are equally spaced apart and formed on the first substrate 10*a*, extending along a first direction; plural pairs of auxiliary electrodes 44 parallel to each other, formed on the plural pairs of transparent electrodes 42 and extending along the first direction, in which each pair of auxiliary electrodes 44 is formed on the gap formed in each transparent electrode 42; a dielectric layer 16 formed to cover the first substrate 10*a*, the plural pairs of transparent electrodes 42 and the plural pairs of auxiliary electrodes 44; a plurality of address electrodes 18 parallel to each other, which are equally spaced apart and formed on the second substrate 10*b*, extending along a second direction that is orthogonal to the first direction; a plurality of spacers (not shown in the drawing) parallel to the plurality of address electrodes 18, formed on the second substrate 10*b*, for defining the discharge space as a pixel array; a plurality of fluorescence layers 22, alternately formed between the plurality of spacers, for luminescing while illuminated by ultraviolet light generated by the discharge of gas in the discharge space caused by applying a voltage to the plurality of address electrodes 18, the plural pairs of transparent electrodes 42 and the plural pairs of auxiliary electrodes 44; in which the plural pairs of auxiliary electrodes 44 are also in contact with the first substrate 10*a* to enhance the adherence of the auxiliary electrodes 44.

The above embodiment can improve the adhesion between the substrate and the auxiliary electrode; however, the bright region can not be enlarged since the position of the auxiliary electrode is the same as that in a conventional PDP.

Figure 5:
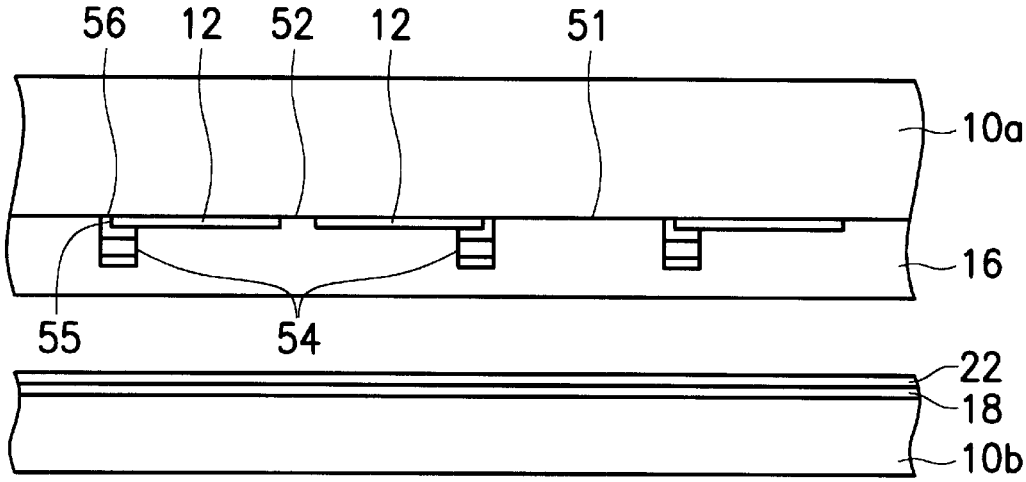
FIG. 5 is a cross-sectional diagram of a plasma display panel device according to another embodiment of this invention.

In the second embodiment of this invention, the adhesion between the substrate and the auxiliary electrode is improved and the bright region of the panel is also enlarged. Referring to FIG. 5, the plasma display panel device has a first substrate 10*a* and a second substrate 10*b* with a discharge space therebetween, and a plurality of pairs of transparent electrodes 12 formed on the first substrate 10*a*, in which each of the transparent electrodes has a sidewall. A reverse slit 51 where no surface discharge occurs is defined between each adjacent pair of transparent electrodes and a discharge slit 52 for surface discharge therebetween is defined between the transparent electrodes of a single pair. The plasma display panel device further includes a plurality of auxiliary electrodes 54 provided near the reverse slits 51. After the auxiliary electrodes are formed, the first surface 55 of each auxiliary electrode is in contact with the sidewall of the transparent electrode, and the second surface 56 of each auxiliary electrode is in contact with the first substrate 10*a* so as to establish a direct adhesion between the auxiliary electrode and the first substrate 10*a*. Each auxiliary electrode can cover the sidewall of the transparent electrode and contact the first substrate 10*a* at the same time, therefore, the adhesion between the substrate and the auxiliary electrode is improved. In addition, the bright region between the pair of auxiliary electrodes is enlarged because the auxiliary electrodes on the transparent electrodes are moved outwardly.

According to the second embodiment of this invention as shown in FIG. 5, a PDP comprises: a pair of substrates including a first substrate 10*a* and a second substrate 10*b*, which are disposed against each other to form a discharge space; plural pairs of transparent electrodes 12 parallel to each other, which are equally spaced apart and formed on the first substrate 10*a*, extending along a first direction; plural pairs of auxiliary electrodes 54 parallel to each other, formed on the plural pairs of transparent electrodes 12 and extending along the first direction, in which each pair of auxiliary electrodes 54 is formed on the interfaces of the first substrate 10*a* and each pair of transparent electrodes 12; a dielectric layer 16 formed to cover the first substrate 10*a*, the plural pairs of transparent electrodes 12 and the plural pairs of auxiliary electrodes 54; a plurality of address electrodes 18 parallel to each other, which are equally spaced apart and formed on the second substrate 10*b*, extending along a second direction that is orthogonal to the first direction; a plurality of spacers parallel to the plurality of address electrodes 18, formed on the second substrate 10*b*, for defining the discharge space as a pixel array; a plurality of fluorescence layers 22, alternately formed between the plurality of spacers, for luminescing while illuminated by ultraviolet light generated by the discharge of gas in the discharge space caused by applying a voltage to the plurality of address electrodes 18, the plural pairs of transparent electrodes 12 and the plural pairs of auxiliary electrodes 54; in which the plural pairs of auxiliary electrodes are also in contact with the first substrate to enhance the adherence of the auxiliary electrodes.

In the above embodiments, the auxiliary electrode has a height of about 2.4 μm and a width of about 70~100 μm. The transparent electrode has a height of about 0.13 μm and a width of about 250~350 μm. Usually, the width of the main bright region is about 400 μm in a conventional PDP. On comparison, the main bright region can be enlarged to 440 μm by using the structure described in the second embodiment. That is, the area of the bright region can be raised up 10% in this invention.

In the above two embodiments, the steps of manufacturing the plasma device panel need not to be changed, the only thing should be amended is the pattern on the photo mask used in the manufacturing process. In the first embodiment, the pattern of the photo mask for forming the transparent electrode should be amended. In addition, the pattern of photo mask for forming the auxiliary electrode has to be amended in the second embodiment.

Figure 6:
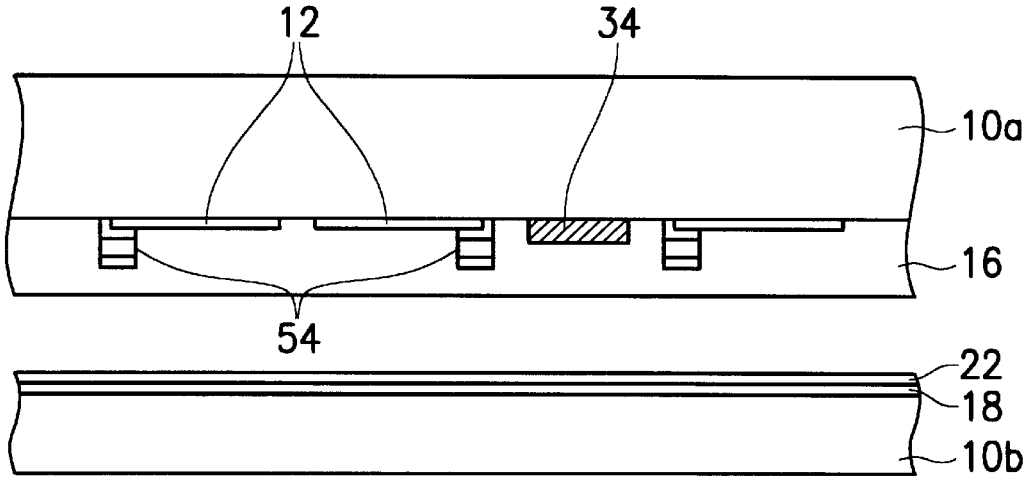
FIG. 6 is a cross-sectional diagram of a plasma display panel device according to the other embodiment of this invention.
Figure 7:
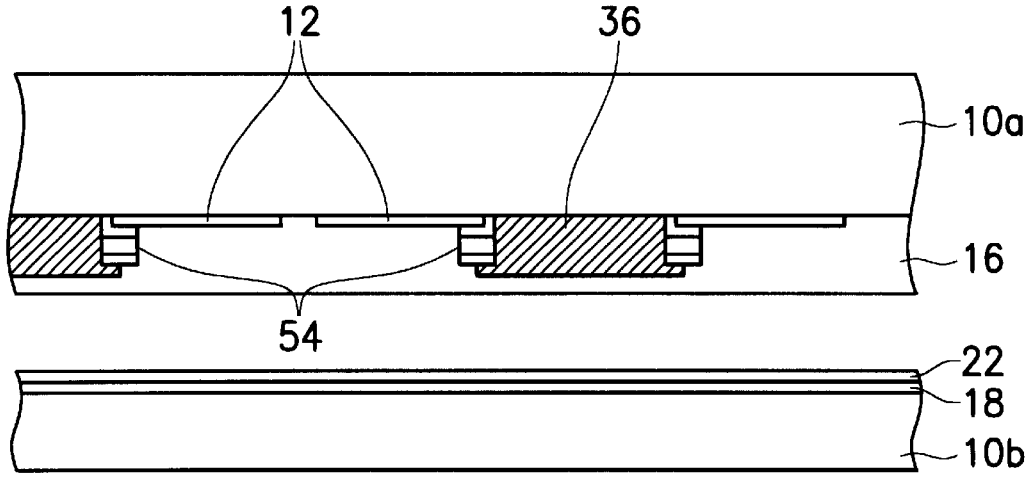
FIG. 7 is a cross-sectional diagram of a plasma display panel device according to a further embodiment of this invention.

Moreover, a black matrix 34 can be formed between each pair of transparent electrodes 12 to improve the contrast of the plasma display panel as shown in FIG. 6. Preferably, the black matrix is made of a non-conductor, such as ink or carbon black, for avoiding short circuit. However, the black matrix may shrink after the ink or carbon black is converted from liquid phase to solid phase. Referring to FIG. 7, the black matrix 36 is formed to cover the gap between the pairs of the electrodes to resist the stress caused by the shrinkage of the ink or carbon black.

In conclusion, the position of the auxiliary electrode is changed in the present invention so the bright region in one pixel is enlarged. Moreover, the auxiliary electrode not only contacts with the transparent electrode but also the first substrate. The substrate is usually made of glass, and the Cr layer of the auxiliary electrode is tightly adhesive to the glass. Therefore, the auxiliary electrode is hardly peeled off. Moreover, the potential difference between Cr and ITO is eliminated when the auxiliary electrode is directly in contact with the substrate. The Cr layer of the auxiliary electrode will not be etched laterally during the etching process.

While the present invention has been particularly shown and described with reference to a preferred embodiment, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. A panel of a plasma display comprising:

a substrate;

a transparent electrode formed on the substrate, the transparent electrode having a sidewall; and an auxiliary electrode including a first surface and a second surface, the first surface being in contact with the sidewall of the transparent electrode and the second surface being in contact with the substrate so as to establish a direct adhesion between the auxiliary electrode and the substrate.

2. A plasma display panel device as claimed in claim 1 wherein the transparent electrode further includes an opening thereon for allowing the second surface of the auxiliary electrode to contact with the substrate through the opening.

3. A plasma display panel device, having a first substrate and a second substrate with a discharge space therebetween, and a plurality of pairs of transparent electrodes formed on the first substrate, each of the transparent electrodes having a sidewall, wherein a reverse slit where no surface discharge occurs is defined between each adjacent pair of transparent electrodes and a discharge slit for surface discharge therebetween is defined between the transparent electrodes of a single pair, the plasma display panel device further comprising:

plurality of auxiliary electrodes provided near the reverse slits, each of said auxiliary electrodes including a first surface and a second surface, the first surface being in contact with the sidewall of each transparent electrode, and the second surface being in contact with the first substrate so as to establish a direct adhesion between the auxiliary electrode and the first substrate.

* * * * *

UNITED STATES PATENT AND TRADEMARK OFFICE

CERTIFICATE OF CORRECTION

PATENT NO. : 6,344,714 B1
DATED : February 5, 2002
INVENTOR(S) : Yao-Ching Su, et al.

It is certified that error appears in the above-identified patent and that said Letters Patent is hereby corrected as shown below:

Title page,
Item [30], should read:
-- [30], Foreign Application Priority Data
Nov. 30, 1998 (TW) ……..87119834 --

Signed and Sealed this

Fourth Day of February, 2003

JAMES E. ROGAN
*Director of the United States Patent and Trademark Office*